United States Patent [19]

Danziger et al.

[11] 4,155,588

[45] May 22, 1979

[54] WHEELCHAIR

[76] Inventors: Uzi Danziger; Reuven Danziger, both of 13 Brener St., Netanya, Israel

[21] Appl. No.: 682,407

[22] Filed: May 3, 1976

[51] Int. Cl.[2] ..... A47C 13/00; A47C 7/54

[52] U.S. Cl. ..... 297/115; 5/81 R; 297/417; 297/DIG. 4

[58] Field of Search ..... 297/42, 44, 45, 115–117, 297/417, DIG. 4; 5/81 R; 280/42, 242 WC

[56] References Cited

U.S. PATENT DOCUMENTS

| | | | |
|---|---|---|---|
| 3,363,939 | 1/1968 | Gross | 297/116 |
| 3,381,973 | 5/1968 | Carr | 297/116 X |
| 3,618,968 | 11/1971 | Greer | 297/DIG. 4 X |
| 3,829,159 | 8/1974 | Leffler | 297/417 |
| 3,901,527 | 8/1975 | Danziger et al. | 297/417 X |
| 3,950,027 | 4/1976 | Wilson | 297/417 X |

*Primary Examiner*—Roy D. Frazier
*Assistant Examiner*—William E. Lyddane
*Attorney, Agent, or Firm*—Browdy and Neimark

[57] ABSTRACT

A wheelchair for the use of invalids has two propelling wheels, at least one of which can be swung rearwardly of the seat of the chair. An armrest is provided which can be swung down, so as to be in the horizontal and permitting the user of the wheelchair to slide on the downswung armrest onto a seating or lying accommodation, the armrest being constituted by two plate elements hinged to one another, so that when unfolded the armrest offers a wide surface adapted to bridge a wide gap between the seat of the wheelchair and an accommodation to which the user of the chair transfers.

6 Claims, 7 Drawing Figures

WHEELCHAIR

BACKGROUND OF INVENTION

The present invention relates to wheelchairs described in U.S. Pat. No. 3,901,527.

The present invention concerns an improvement in the wheelchairs described in that specification. According to that specification one, or both of the propelling wheels of the wheelchair are adapted to be swung rearwardly of the chair so as to free the passage of an occupant when the latter is to be shifted from the chair onto a bed or another resting place or is to be moved into a car. To this end the side wall and armrest of the chair are foldable and can be put into a horizontal position, so that the occupant of the chair can slide on the said horizontally placed armrest which with one edge is supported on the bed or other place onto which the occupant of the chair wishes to move or is to be moved.

It has been found that the height of such an armrest, that is to say its width in horizontal position is frequently insufficient to bridge the gap between the wheelchair and the supporting surface onto which the occupant of the chair is to be moved.

SHORT SUMMARY OF DISCLOSURE

In accordance with the present invention—the said armrest of the wheelchair is constituted by two plate elements hinged to one another at their edge which is uppermost in the vertical position of the armrest, it being thus possible to unfold the armrest, when swung down, giving it double width so as to be able to bridge the gap between the seat of the wheelchair and the surface onto which the occupant of the chair is to be moved. According to a further feature of the invention the armrest constituted by the said two plates is held in vertical position by a rail of U profile which straddles the assembly of the two plates at the uppermost edge thereof, the said rail being affixed to an arm which can be swung through at least 90° about a vertical axis, so that the said rail and arm extend in line with the rear or backrest of the wheelchair and afford lateral or rear support for the occupant while sliding over the unfolded armrest.

These and further features of the invention will be described in the following description which has reference to the annexed drawings.

SHORT DESCRIPTION OF THE DRAWINGS

In the drawings

DESCRIPTION OF PREFERRED EMBODIMENT

Figure 1:
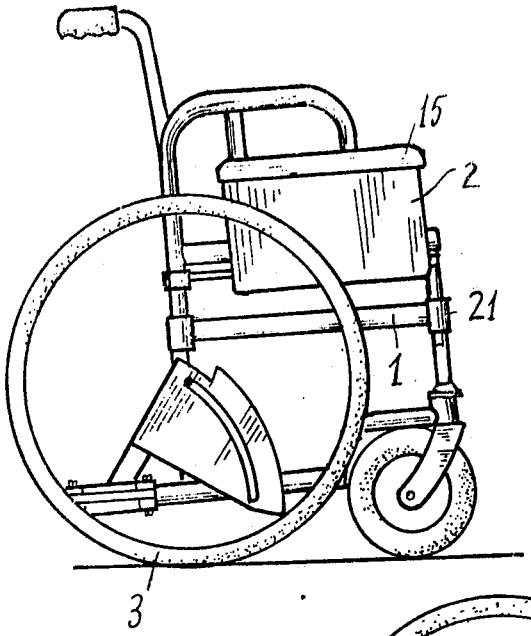
FIG. 1 is a lateral elevation of a chair according to the invention with its propelling wheel in normal, i.e. traveling condition.
Figure 2:
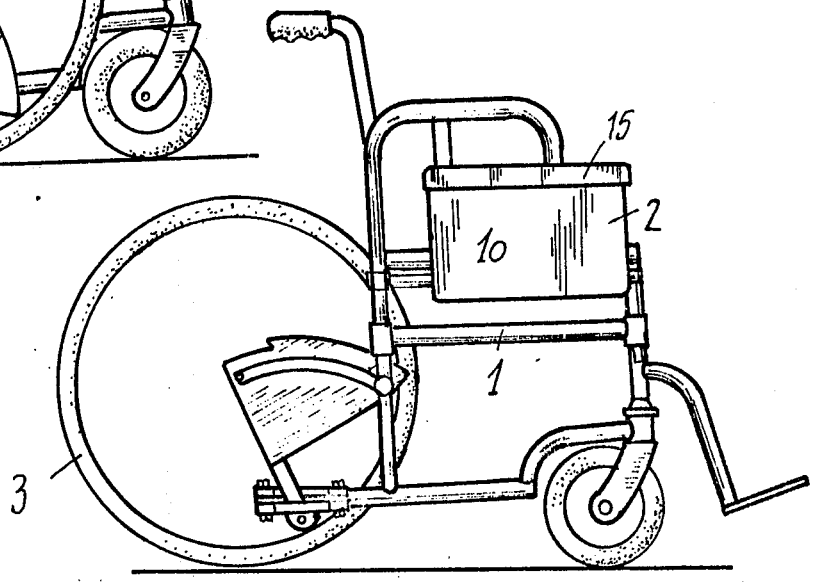
FIG. 2 is a like view of the chair with the propelling wheel in rearward position.

The wheelchair shown in FIGS. 1 and 2 is of the type and kind described in the above named earlier patent and needs no further description. It comprises the seat 1 and an armrest indicated as a whole by the numeral 2. The propelling wheel 3 can be swung from the normal position of FIG. 1 into the position of FIG. 2, thus freeing the passage for the occupant of the chair from the chair sidewardly onto another seat, bed or the like. No further description of the said two figures is deemed necessary since reference for details can be had to the above named patent specification.

Figure 3:
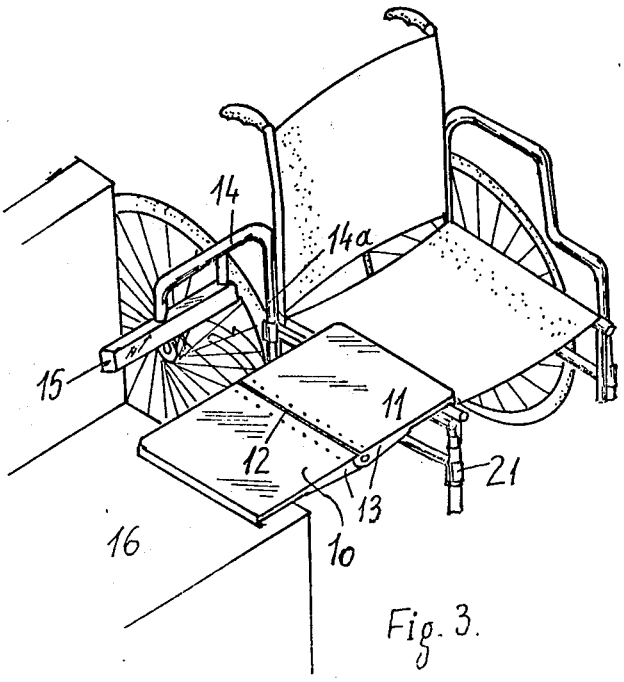
FIG. 3 is a perspective view of the wheelchair with one armrest swung out and resting on the seat of a stationary chair.
Figure 4:
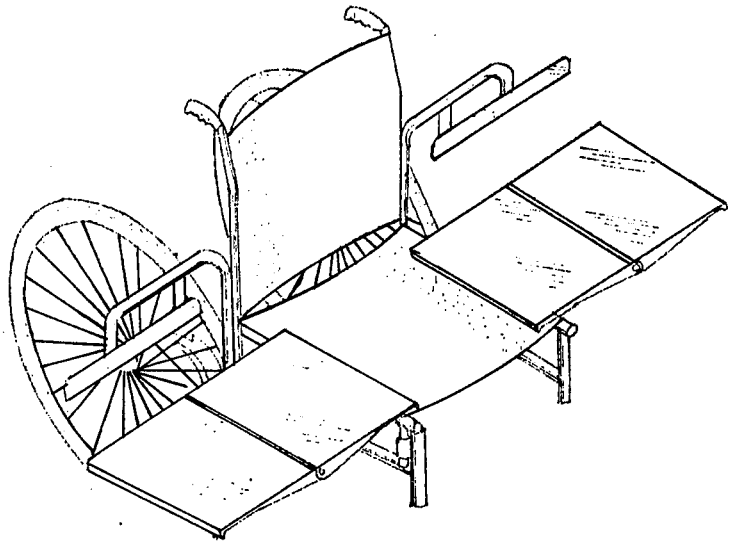
FIG. 4 is a like view showing both armrests swung out.
Figure 5:
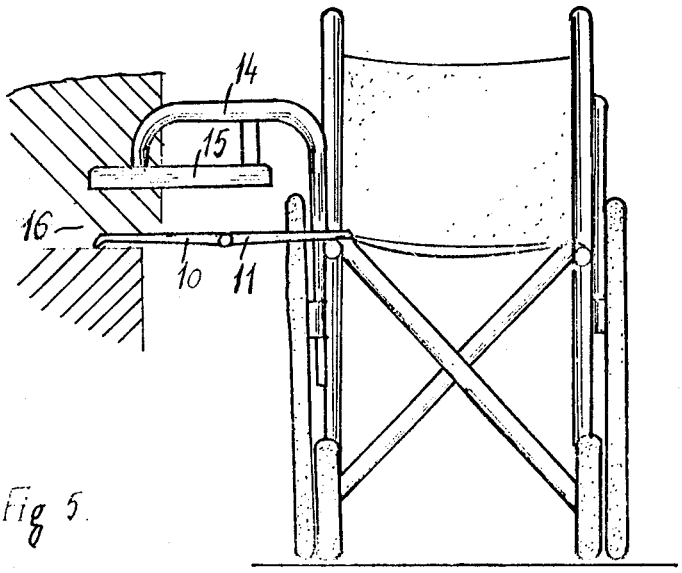
FIG. 5 is a frontal, elevational view of the wheelchair—in the position of FIG. 3.

Turning now to FIG. 3, it can be seen that the armrest is composed of the following components: two plates 10 and 11 which are hingedly connected at the line 12 and which are stiffened and held in a co-planar position by two braces 13.

The armrest further comprises a gallows-like arm 14 the vertical portion of which is turnable. To the downwardly bent part of the horizontal arm of the part 14 is fixedly attached a rail 15 of U profile. In the normal position of the chair (see FIGS. 1 and 2) the rail 15 straddlingly encloses the upper edge of the folded armrest plates 10, 11. The rail 15 thus locks the two plates in position, so that folded onto one another and positioned in vertical planes they serve as an armrest with rail 15 forming the top edge thereof.

In order to use the armrest as a sliding or transfer board, the gallows-like arm 14 is slighly raised and swung into the position shown in FIG. 3. Now the two boards 10 and 11 can be unfolded and the extreme outer edge of board 10 can be rested on whatever surface, say the seat of a chair 16 shown in FIG. 3. The occupant of the wheelchair can now transfer himself or can be shifted on the transfer board constituted by the two plates 10, 11 onto the seat 16. Obviously in the same way a patient could be transferred to his or her bed or can be moved into a car.

At the time of transfer, in those cases where the wheelchair occupant needs also a support at his back, such as patients whose stomach muscles are too weak to hold them upright, the structure 14, 15 will afford the said rear support.

Figure 6:
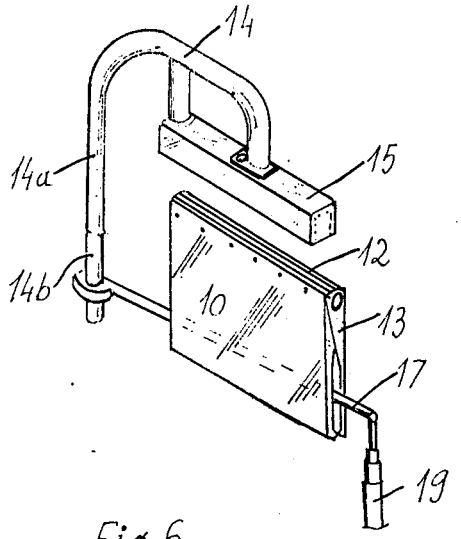
FIGS. 6 and 7 are perspective views of the mechanism for unfolding and swinging out the armrest.
Figure 7:
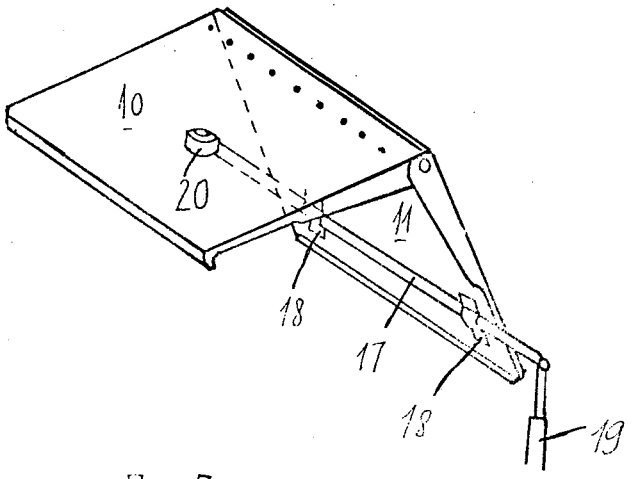

Turning now to FIGS. 6 and 7, the details of the construction of the transfer board can be gathered therefrom. The bent arm 14 is turnable about a vertical axis so that the rail 15 can be brought into the position shown in FIG. 6 or in a position at right angles thereto. The vertical portion of arm 14 is composed of two parts **14*a* and 14*b*, the latter being of slightly smaller diameter than the former. This thinner part can be slid into an eye formed at the chassis of the chair. In order to accomplish the swinging out of the rail 15 the latter can be raised slightly by sliding part 14*b* upwardly. In the outswung position the transfer board composed of plates 10 and 11 is held co-planarly and is prevented from further relative movement by braces 13**.

In order to unfold the two plates 10 and 11 a simple mechanism is provided consisting of a bar 17 turnably held in two eyes 18, affixed to the underside of plate 11. Bar 17 has affixed to it a vertical rod 19 which slides telescopingly in an eye in an upright of the chair's chassis (e.g. 21 in FIG. 1). When the board is unfolded an eye 20 at the inner end of the bar 17 slides on upright **14*b***. When the two plates are unfolded they are supported on one side by the seat of the wheelchair and at the opposite edge on the support to which the occupant of the chair is to be transferred.

What is claimed is:

1. A wheelchair, comprising:

a chassis;

a seat for a rider mounted on said chassis;

first and second propelling wheels disposed on opposite sides of said chassis;

first and second armrests attached to opposite sides of said chassis, at least one of the said armrests comprising two rigid plates, a first plate which is hingedly attached to said chassis adjacent a first edge of said first plate to be swingable from a vertical position to a horizontal position, and a second plate having a first edge which is hingedly attached to a second edge of said first plate opposite the first edge thereof, to be swingable into horizontal position to extend co-planary with said first plate; and armrest locking means attached to said chassis for securing said two rigid plates in the vertical position, said armrest locking means comprising a gallows-like arm including a vertical member mounted on said chassis to slide vertically and to pivot about a vertical axis, and a substantially horizontal rail of inverted U-profile connected to said vertical member, said rail straddling the hingedly attached edge portions of said two rigid plates when said two rigid plates are in the vertical position and folded onto one another, thereby retaining the armrest plates in the vertical position.

2. A wheelchair according to claim 1, wherein the first edge of said first plate, when in the vertical position, extends below the level of said seat, and said chassis further includes vertically slidable means, said means being attached to and vertically slidable with respect to the remainder of said chassis, said vertically slidable means being the portion of said chassis to which said first plate is hingedly attached, whereby said vertically slidable means is in its lowest position when said two rigid plates are locked in the vertical position, and said vertically slidable means can slide upwardly to allow the lower edge of said first plate to be raised above said seat to permit said plates to be swung into said horizontal position and to permit said first plate to rest on said seat for support.

3. A wheelchair according to claim 2, wherein said vertically slidable means comprises a horizontal bar, said horizontal bar being the portion of said vertically slidable means to which said first plate is hingedly attached, and two vertical bars connected respectively to each end of said horizontal bar and to said remainder of said chassis such that said horizontal bar is vertically slidable with respect to said remainder of said chassis.

4. A wheelchair according to claim 1 wherein said armrest locking means is pivotable through 90°, whereby said armrest locking means may be rotated so that said rail extends parallel to the rear of said plates when in a horizontal position to provide a back support along the horizontal plates.

5. A wheelchair according to claim 1, wherein at least one of said first and second propelling wheels can be swung rearwardly of said seat.

6. A wheelchair according to claim 1, wherein said gallows-like arm comprises said vertically slidable and pivotable vertical member as well as a horizontal arm attached to said vertical member and at least one vertical arm attached to said horizontal arm, said rail of inverted U-profile being connected to the end of said vertical arm opposite to the end thereof attached to said horizontal arm, thus connecting said rail to said vertical member by means of said vertical arm and said horizontal arm.

* * * * *